US007267732B2

(12) United States Patent
Tsukamoto et al.

(10) Patent No.: US 7,267,732 B2
(45) Date of Patent: Sep. 11, 2007

(54) METHOD FOR MANUFACTURING STEEL PARTS BY CONTINUOUS COPPER-BRAZING AND QUENCH HARDENING

(75) Inventors: Hideharu Tsukamoto, Fukuroi (JP); Katsutoshi Yoshizawa, Hiratsuka (JP); Hiroaki Yamashita, Hiratsuka (JP)

(73) Assignees: NSK-Warner K.K., Tokyo (JP); Kanto Yakin Kabushiki Kaisha, Kanagawa-ken (JP)

( * ) Notice: Subject to any disclaimer, the term of this patent is extended or adjusted under 35 U.S.C. 154(b) by 518 days.

(21) Appl. No.: 10/911,484

(22) Filed: Aug. 5, 2004

(65) Prior Publication Data

US 2005/0028904 A1 Feb. 10, 2005

(30) Foreign Application Priority Data

Aug. 7, 2003 (JP) ..... 2003-206468

(51) Int. Cl.
*C21D 1/18* (2006.01)

(52) U.S. Cl. ..... 148/528; 148/529

(58) Field of Classification Search ..... 148/528
See application file for complete search history.

(56) References Cited

U.S. PATENT DOCUMENTS 5,955,208 A * 9/1999 Takahashi ..... 428/685
6,293,313 B1 * 9/2001 McCrink ..... 138/172

FOREIGN PATENT DOCUMENTS

JP 63-54929 10/1988
JP 4-327031 11/1992

* cited by examiner

*Primary Examiner*—George Wkyszomierski
(74) *Attorney, Agent, or Firm*—Shlesinger, Arkwright & Garvey LLP

(57) ABSTRACT

There is provided a method for manufacturing steel parts for an automotive automatic transmission in which a desired joint portion of each steel part is copper-brazed at a high temperature while chromium in an alloy steel for machine structural use forming the steel part for an automotive automatic transmission is kept in a reducing atmosphere and without removal of carbon, and the part is successively reheated continuously with the copper brazing by utilizing residual heat at the time of copper brazing, by which the temperature of the part is increased to perform quench hardening. In the above-described manufacturing method, the heating treatment for copper brazing of the part and the heating treatment for quenching thereof are connected to each other via an intermediate cooling treatment in which the temperature of the part is decreased to a temperature below the Ar1 point, and these heating treatments are performed in an atmosphere of a neutral gas such as nitrogen gas supplied into a graphite muffle. At this time, the gas atmosphere is reducing and carburizing, and the temperature increase for copper brazing and quench hardening of the part is accomplished continuously and freely without oxidation of chromium or removal of chromium and carbon.

7 Claims, 2 Drawing Sheets

METHOD FOR MANUFACTURING STEEL PARTS BY CONTINUOUS COPPER-BRAZING AND QUENCH HARDENING

BACKGROUND OF THE INVENTION

1. Field of the Invention

The present invention relates to a method for manufacturing steel parts for an automotive automatic transmission in which a desired portion of steel part for an automotive automatic transmission using an alloy steel for machine structural use as a material is copper-brazed at a high temperature and then this part is quench hardened.

2. Description of the Related Art

A joint portion of steel parts for an automotive automatic transmission is copper-brazed at a high temperature so that the parts can sufficiently withstand a load applied to the parts at the time of their operation. Also, the parts must be quench hardened because they are functional parts.

The high-temperature copper brazing and subsequent quench hardening treatments of the parts have been carried out by various methods.

For example, Japanese Patent Publication No. 63-54929 and Japanese Patent Laid-Open No. 4-327031 have disclosed methods in which parts are heated in batches to be subjected to high-temperature copper brazing and quench hardening. With these methods, because the parts are treated in batches, troublesome work is required, and also there remain questions as to whether oxidation or removal of chromium contained in the alloy steel for machine structural use forming the parts can be prevented and whether removal of carbon from the steel can be prevented.

The alloy steel for machine structural use, which has been exposed to a high temperature to be copper-brazed, is rapidly cooled to a temperature of approximately 550° C. below the Ar1 point generally common to the steels of this kind, and then allowed to cool by means of air cooling etc. to prevent a deposit from being produced in the steel and the structure from being made rough. The steel parts for an automotive automatic transmission are reheated to a temperature of 830 to 880° C. above the Ac3 point after they are rapidly cooled and air cooled after copper-brazed in this manner, by which the structure is austenitized and quench hardened.

SUMMARY OF THE INVENTION

Accordingly, an object of the present invention is to provide a method for manufacturing steel parts for an automotive automatic transmission in which a desired portion of the steel part is copper-brazed at a high temperature while chromium in an alloy steel for machine structural use forming the steel parts for an automotive automatic transmission is kept in a reducing atmosphere and carbon or chromium is prevented from being removed from the steel, and the part is successively reheated by utilizing residual heat accumulated in the part at the time of copper brazing, by which the structure is austenitized and quench hardened.

The inventor(s) first paid attention to the fact that the alloy steel for machine structural use forming the steel parts for an automotive automatic transmission in accordance with the present invention can be quench hardened at a temperature below the heating temperature for copper brazing. Based on this fact, the above-described problems were solved as described below.

In the present invention, to copper-braze the steel parts in accordance with the present invention, a graphite muffle, which is a carbon material, was used, and the atmosphere in the muffle was made an atmosphere of a neutral gas such as nitrogen gas. Although the gas used, for example, nitrogen gas is treated to remove oxygen as much as possible, the gas still contains a minute amount of oxygen, and this oxygen reacts with the carbon material of muffle to yield CO.

That is to say, oxygen is completely removed from nitrogen in the muffle, and nitrogen creates a neutral and inactive atmosphere. On the other hand, in this atmosphere, the aforementioned Co having Pco of $10^{-3}$ atm to $10^{-6}$ atm exists, so that this atmosphere is reducing and carburizing one.

Therefore, at the time of copper brazing, Chromium in the steel part is in a reducing atmosphere, and also the steel part is not decarburized.

A muffle for quench heating following the copper brazing is also made of graphite of a carbon material in the present invention, and for the atmosphere in this muffle as well, a neutral gas such as nitrogen gas is used in the present invention. Therefore, even at the time of cooling and quench heating treatments performed continuously after the brazing treatment, the steel part is placed in a reducing and carburizing atmosphere.

In the present invention, at the time of cooling treatment, the part is rapidly cooled to a temperature below the Ar1 point of the alloy steel, and successively at the time of quench heating, the part is reheated to a temperature in the range above the Ac3 point and below the brazing temperature, by which the alloy steel structure of part can be austenitized and quench hardened.

Thereupon, the present invention enabled steel parts for an automotive automatic transmission to be manufactured by causing the steel parts to pass through a series of continuing furnaces and by performing copper brazing and quench hardening of the steel parts continuously without impairing the structure and composition of steel thereof.

DETAILED DESCRIPTION OF THE PREFERRED EMBODIMENTS

Figure 1:
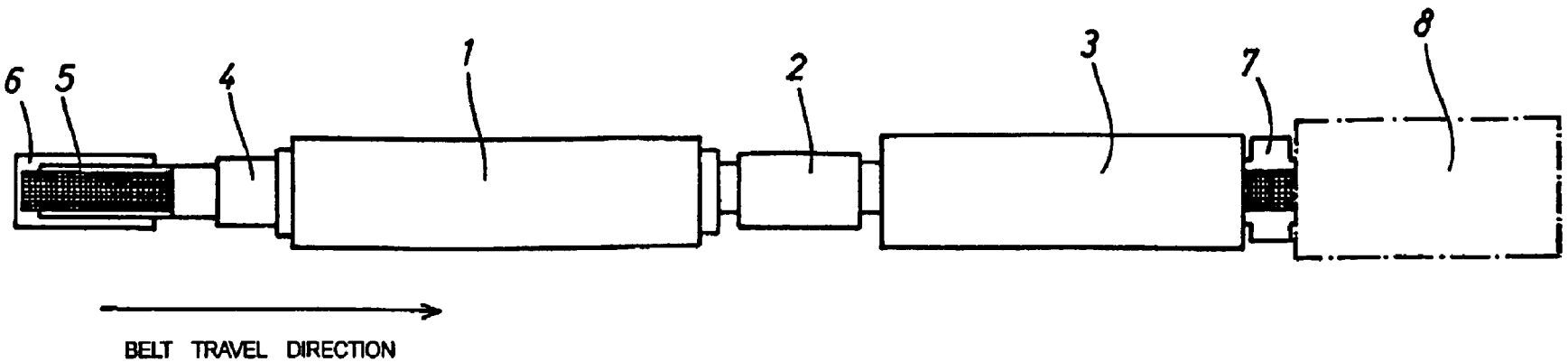
FIG. 1 is a plan view explanatorily showing one example of a continuous furnace suitable for carrying out a method in accordance with the present invention.

A method in accordance with the present invention will now be described in more detail with reference to the accompanying drawings. FIG. 1 is a plan view explanatorily showing a continuous furnace suitable for carrying out the method in accordance with the present invention. In a copper brazing furnace 1, a graphite muffle, which has a rectangular cross section and is heat insulated by ceramic fiber, extends along the centerline in the lengthwise direction of furnace in a tunnel shape. Like the copper brazing furnace 1, a quench furnace 3 has a tunnel-shaped graphite muffle extending along the centerline in the lengthwise direction of furnace. A neutral gas, for example, nitrogen gas is sent into each of the muffles to produce an atmosphere. The atmosphere in the muffle is heated to a desired temperature by using many heaters provided on the outside of the muffle.

Reference numeral 2 denotes an intermediate cooling chamber which is provided between the copper brazing furnace 1 and the quench furnace 3 so as to connect these furnaces to each other. In the intermediate cooling chamber 2, as in the brazing furnace 1 and the quench furnace 3, a tunnel-shaped muffle extends along the centerline in the lengthwise direction of chamber. Nitrogen gas is also sent into the muffle in the intermediate cooling chamber 2, and the neutral gas is cooled to a desired temperature by a water cooling jacket which surrounds the muffle from the outside.

Reference numeral 4 denotes a front chamber of the brazing furnace 1, and reference numeral 8 denotes a quenching device.

Figure 2:
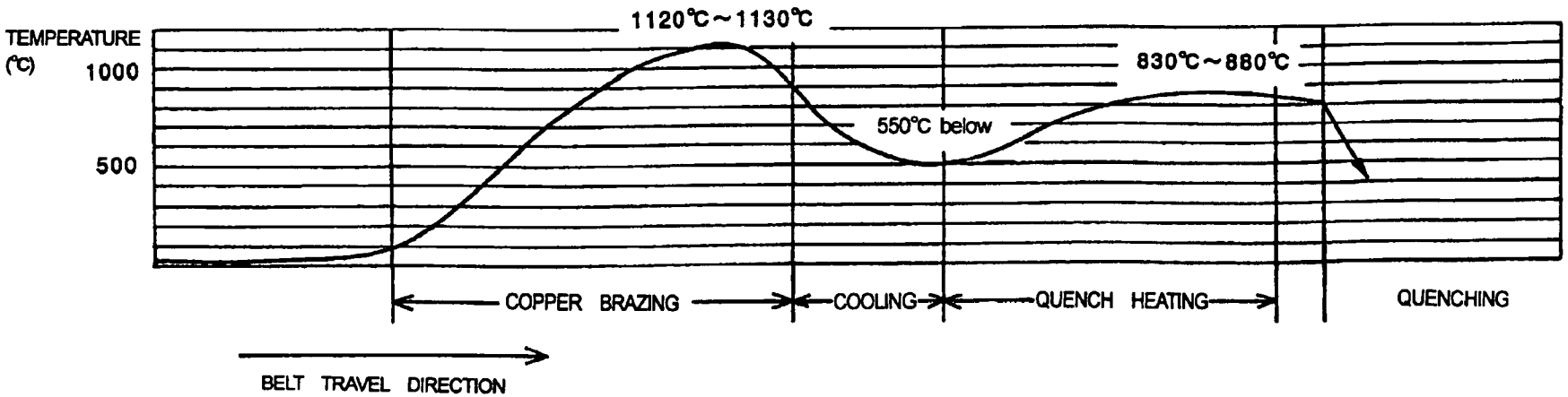
FIG. 2 is a graph showing one example of a heat pattern obtained by carrying out a method in accordance with the present invention by using the continuous furnace shown in FIG. 1.

As described above, the graphite muffles in the front chamber 4, the brazing furnace 1, the intermediate cooling chamber 2, and the quench furnace 3 are connected to each other in a tunnel shape, and a mesh belt 5 made of stainless steel, which is driven in the graphite muffles by a driving device 6 and a driven device 7, circulates in the arrow-marked direction in FIG. 2.

EXAMPLE

Nitrogen gas (DP: −72° C., $O_2$ concentration: 2 ppm or lower) was sent to the continuous front chamber 4, brazing furnace 1, intermediate cooling chamber 2, and quench furnace 3 through a feed pipe (not shown) at a feed rate of 50 $Nm^3$/hr under a feed pressure of 0.5 MPa, and was exhausted to the outdoor under a static pressure of 0.15 KPa through an exhaust pipe (not shown).

Many brake bands (outside diameter: 174 mm, width: 41 mm, weight: 440 g), brake component parts each forming a part of an automotive automatic transmission, formed of a Cr-Mo based steel (JIS G4105 SCM435) (having a composition of 0.35% C, 0.25% Si, 0.7% Mn, 1.0% Cr, 0.2% Mo, the balance being Fe), which had a joint portion to be copper-brazed, were successively placed on the mesh belt 5, and conveyed into the brazing furnace 1 through the front chamber 4 at a conveying speed of 275 mm/min in order for the joint portion to be copper-brazed. The nitrogen atmosphere heated in the graphite muffle of the brazing furnace at this time had Pco in the range of $10^{-3}$ to $10^{-6}$ atm and a reducing and carburizing atmosphere.

This Cr-Mo based steel part was copper-brazed by being heated according to a heat pattern shown in FIG. 2 and being held at 1120 to 1130° C. for two minutes in the brazing furnace 1.

The brazed steel part went out of the brazing furnace 1 and was conveyed into the intermediate cooling chamber 2. The nitrogen atmosphere in the intermediate cooling chamber 2 was cooled by water having a temperature of 32° C. or lower, which was sent to the water cooling jacket surrounding the cooling chamber at a feeding rate of 80 L/min under a feed pressure of 0.5 MPa. In the intermediate cooling chamber 2, the steel part was cooled to a temperature of 550° C. below the Ar1 point in six minutes, by which the steel structure was made fine.

Successively, the part was conveyed into the quench furnace 3 by using the mesh belt 5, reheated to a temperature in the range of 830 to 880° C. as shown by the heat pattern shown in FIG. 2 in the graphite muffle of the quench furnace 3 to austenitize the steel structure of part, and kept in the aforementioned temperature range for three minutes. Thereafter, the part was separated from the mesh belt 5, and quenched in the quenching device 8 of 70° C. The hardness of the part was HRC55, and the hardness thereof after being tempered subsequently at 450° C. for 30 minutes was HRC43. That is, a satisfactory quenching and tempering effect was recognized. The joint portion of part was naturally brazed properly, no decarburized layer being found in the steel of part, and a high-quality product without deformation and dechromium was obtained.

The method for manufacturing steel parts for an automotive automatic transmission in accordance with the present invention achieved a prominent effect that a steel part for an automotive automatic transmission can be copper-brazed properly without removal of carbon and chromium, and moreover the part can be quench-heated continuously with copper brazing treatment by utilizing residual heat at the time of copper brazing. Therefore, the length of a heating line for copper brazing and quench hardening was decreased, so that the quantity of atmospheric gas used was saved, which achieved an economical effect.

In the above-described embodiment, Cr-Mo based alloy steel is used as a material for the steel part for an automotive automatic transmission. However, it is a matter of course that other alloy steels for machine structural use capable of being quench hardened at a temperature below the copper brazing temperature can also be used in the present invention. As such an alloy steel, there are available, for example, manganese steels (SMn 433, SMn 438, SMn 443), manganese-chrome steels (SMnC 443), chromium steels (SCr 430, SCr 435, SCr 440, SCr 445), chrome-molybdenum steels (SCM 430, SCM 432, SCM 435, SCM 440, SCM 445), nickel-chrome steels (SNC 236, SNC 631, SNC 836), nickel-chrome-molybdenum steels (SNCM 240, SNCM 431, SNCM 439, SNCM 447, SNCM 625, SNCM 630), and aluminum-chrome-molybdenum steels (SACM 645).

What is claimed is:

1. A method for manufacturing steel parts for an automotive automatic transmission, comprising copper-brazing and subsequently quench hardening each steel part wherein the steel part is copper-brazed without removal of carbon and chromium and quench hardened by residual heat generated during the copper brazing step, said steel parts are conveyed continuously into a graphite muffle for brazing in a neutral gas atmosphere, where said steel parts are heated and a desired portion thereof is copper-brazed at a high temperature; successively, said steel parts are conveyed continuously into a muffle for cooling which connects with said muffle for brazing and is in the same atmosphere as said neutral gas atmosphere, where said steel parts are cooled to a temperature as high as possible but at least below the Ar1 point of an alloy steel forming said steel parts; and further successively, said steel parts are conveyed continuously into a muffle for quench heating which connects with said muffle for cooling and is in the same atmosphere as said neutral gas atmosphere, where said steel parts are reheated continuously for quenching to a desired high temperature that is below said copper brazing temperature and above the Ar1 point, by which said steel parts are copper-brazed and quench hardened continuously.

2. The method of manufacturing steel parts for an automotive automatic transmission according to claim 1, wherein said steel parts are quench hardened at a temperature lower than said copper brazing temperature.

3. The method for manufacturing steel parts for an automotive automatic transmission according to claim 2, wherein said copper brazing temperature of the steel parts is from 1120 to 1130° C.

4. The method for manufacturing steel parts for an automotive automatic transmission according to claim 2, wherein an alloy steel forming said steel parts is a Cr-Mo based alloy steel.

5. The method for manufacturing steel parts for an automotive automatic transmission according to claim 1, wherein said copper brazing temperature of the steel parts is from 1120 to 1130° C.

6. The method for manufacturing steel parts for an automotive automatic transmission according to claim 5, wherein an alloy steel forming said steel parts is a Cr-Mo based alloy steel.

7. The method for manufacturing steel parts for an automotive automatic transmission according to claim 1, wherein an alloy steel forming said steel parts is a Cr-Mo based alloy steel.

* * * * *